US009567153B2

(12) United States Patent
Calligaro

(10) Patent No.: US 9,567,153 B2
(45) Date of Patent: Feb. 14, 2017

(54) METHOD OF MAKING AND PROCESSING CHEESE IN DOME CONTAINERS

(71) Applicant: Leo Calligaro, Cocoa, FL (US)

(72) Inventor: Leo Calligaro, Cocoa, FL (US)

( * ) Notice: Subject to any disclaimer, the term of this patent is extended or adjusted under 35 U.S.C. 154(b) by 21 days.

(21) Appl. No.: 14/633,926

(22) Filed: Feb. 27, 2015

(65) Prior Publication Data

US 2016/0251147 A1 Sep. 1, 2016

(51) Int. Cl.
*B65D 85/76* (2006.01)
*B65B 25/06* (2006.01)

(52) U.S. Cl.
CPC ..... *B65D 85/76* (2013.01); *B65B 25/068* (2013.01)

(58) Field of Classification Search
CPC ... A23C 19/097; A23C 19/00; A23C 19/0684; A23C 19/076; A23C 19/02; A23G 3/12; B65D 81/00; B65D 85/8043; B65D 85/76; A23P 1/10; B65B 3/02; B65B 3/022; B65B 25/068
USPC ..... 426/582, 36, 119, 120, 130, 392, 396,426/512; 220/608, 359.1; 53/469, 477, 478, 53/485, 173, 284.5, 329.2, 329.3, 287, 373.3; 206/484, 559
See application file for complete search history.

(56) References Cited

U.S. PATENT DOCUMENTS 3,597,899 A * 8/1971 Hanson ..... B29C 65/18 53/511
4,205,750 A * 6/1980 Dews ..... B65D 77/06 206/497
2004/0005475 A1* 1/2004 Curie ..... B32B 27/08 428/522
2006/0286217 A1* 12/2006 Gelotte ..... A23B 7/148 426/106
2008/0305209 A1* 12/2008 Mattei ..... A23C 19/0684 426/39
2009/0045095 A1* 2/2009 Wagner ..... A23B 7/157 206/524.4
2010/0076124 A1* 3/2010 Yawata ..... C07D 339/02 524/84

* cited by examiner

*Primary Examiner* — Michele L Jacobson
*Assistant Examiner* — Ericson M Lachica
(74) *Attorney, Agent, or Firm* — Brian S. Steinberger; Law Offices of Brian S. Steinberger, P.A.

(57) ABSTRACT

Processes, methods, systems, containers, and apparatus for making and processing pasta filata cheese in dome containers that are packaged in plastic. The novel invention uses a rigid see through plastic dome to safely store the cheese within and can be heat sealed in a bag with a plastic film across the top of the bag and open end of the dome. Another embodiment uses only a plastic film to seal off the open end of the dome without using a bag. The process eliminates the need for a water tank to hold the cheese balls before packaging, where water has allowed for cross contamination of all the balls if one ball is contaminated with bacteria and germs. The plastic dome allows for an aesthetically appearing cheese package that maintains a semi-spherical ball shape with the dents and deformations that occur with the prior art plastic bag packaged cheeses.

12 Claims, 5 Drawing Sheets

METHOD OF MAKING AND PROCESSING CHEESE IN DOME CONTAINERS

FIELD OF INVENTION

This invention relates to cheese, and in particular to processes, methods, systems, containers, and apparatus for making and processing pasta filata cheese in dome containers that are packaged in plastic bags with sealed film covers or in the dome containers with the plastic film cover.

BACKGROUND AND PRIOR ART

FIG. 1 is a flowchart of the prior art general steps for plastic packaging soft pliable cheese, such as pasta filata cheeses that include mozzarella. A first step includes taking molded cheese balls and dropping the still pliable cheese balls from a molding machine into a cold water recirculating tank, 1. Next, the cold water recirculating tank is rolled to a cooler for the cheese balls to further chill, 2. Step 3 has the chilled still pliable cheese balls removed from the recirculation tank and loaded into pre-formed plastic bags that are placed into a heat sealing machine. Step 4 has the plastic bags containing the pliable cheese balls being processed through the heat sealing machine with plastic film sealed to the open top of the bags completing the packaging process.

The prior art process requires a chilled open top water tank which causes many problems. For example, the tank can cause cross-contamination of all the cheeses being stored therein from bacteria and germs caused by workers that put their hands in the water tanks. Contamination can also be caused by airborne germs, dirt, dust, and the like, that come into contact with the exposed water. Any contamination will potentially cross-contaminate not just one but all of the cheese balls in the tank.

Additionally, the prior art generally requires the water be chilled, which means that energy costs are incurred to chill the water so that the balls can be inserted inside. Still furthermore, each of the balls when removed from the water tank need to be dried off before being heat sealed in the plastic bags with the film cover, since the heat sealing will not adequately seal the bags if water is on the plastic bags and/or film covers. The labor to shake off or dry the water remnants on the bags is another expense to the process. Additionally, the extra handling by the worker to try to dry off the bags also adds to additional contamination of the cheese.

Finally, the bagged cheese does not have an aesthetic pleasing appearance. Packaging the pliable cheese in a thin filmed plastic bag allows for indentations, such as from fingers of handlers, to pass through the flexible bag to the cheese causing the cheese to be deformed resulting with indentations causing an ugly undesirable appearance on the shelves of markets.

Thus, the need exists for solutions to the above problems with the prior art.

SUMMARY OF THE INVENTION

A primary objective of the present invention is to provide processes, methods, systems, containers, and apparatus for making and processing pasta filata cheese in dome containers that are packaged in plastic bags with film covers or with just film covers, which are more efficient and has fewer steps than traditional packaging steps.

A secondary objective of the present invention is to provide processes, methods, systems, containers, and apparatus for making and processing pasta filata cheese in dome containers being packaged in plastic bags with film covers or with just film covers, without using a water tank.

A third objective of the present invention is to provide processes, methods, systems, containers, and apparatus for making and processing pasta filata cheese in dome containers being packaged in plastic bags with film covers or with just film covers, that does not require the cheese to be chilled, and eliminates extra energy costs for cooling.

A fourth objective of the present invention is to provide processes, methods, systems, containers, and apparatus for making and processing pasta filata cheese in dome containers being packaged in plastic bags with film covers or with just film covers, which substantially reduces contamination of the cheese caused from physical handling the cheese.

A fifth objective of the present invention is to provide processes, methods, systems, containers, and apparatus for making and processing pasta filata cheese in dome containers being packaged in plastic bags with film covers or with just film covers, which substantially reduces contamination of the cheese caused from open air contamination exposure of the cheese.

A sixth objective of the present invention is to provide processes, methods, systems, containers, and apparatus for making and processing pasta filata cheese being packaged in plastic, which results in an aesthetic appearing cheese product without having substantial finger print or other deformations in the packaged product.

A process for packaging cheese can include the steps of inserting cheese into a plastic dome having an upper open end and a lower rounded end, placing the rounded end of the dome with cheese into an open end of a plastic bag, and sealing a plastic film to the open end of the bag holding the dome and the cheese. The process can further include the step of providing a pasta filata cheese as the cheese.

The process can further include the step of providing the plastic dome with a rim about the upper open end. The plastic dome can include walls having a thickness of approximately 25 mils to approximately 30 mils.

The plastic bag and the plastic film can each have a thickness of approximately 7 mils to approximately 8 mils.

The process can further include the step of forming the plastic dome from a UV (ultra violet) and Oxygen barrier, as a clear see-through plastic.

The sealing step can include the step of heat sealing the plastic film to upper ends of the dome and the bag.

The packaging process can be used without the bag, where just the open upper end of the dome container is sealed with a plastic film.

A novel see-through container for cheese can comprise a plastic dome having an open upper end, and sidewalls which run down to a closed rounded bottom end, wherein pasta filata cheese is stored inside of the dome.

The container can include an outward extending rim about the open upper end of the dome. The sidewalls and closed bottom end of the dome can have a wall thickness of approximately 25 mils to approximately 30 mils.

The container can include a plastic bag for holding the dome with cheese therein, and a plastic film for closing off the open upper end of the dome and for sealing the bag.

The container can also include the plastic film for sealing off the upper open end of the dome, without the plastic bag.

The sidewalls and closed bottom end of the dome can have a wall thickness of approximately 25 mils to approximately 30 mils. The plastic bag and the plastic film can each have a thickness of approximately 7 mils to approximately 8 mils.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

| | |
|---|---|
| 120 | dome container (plastic shape cup) |
| 130 | cheese ball (and/or generally hemi-spherical) |
| 140 | tray |
| 150 | compartment(s) of tray |
| 160 | plastic bag |
| 170 | top plastic film |
| 200 | packaged cheese in dome container sealed in bag with heat sealed top film cover |

Figure 1:
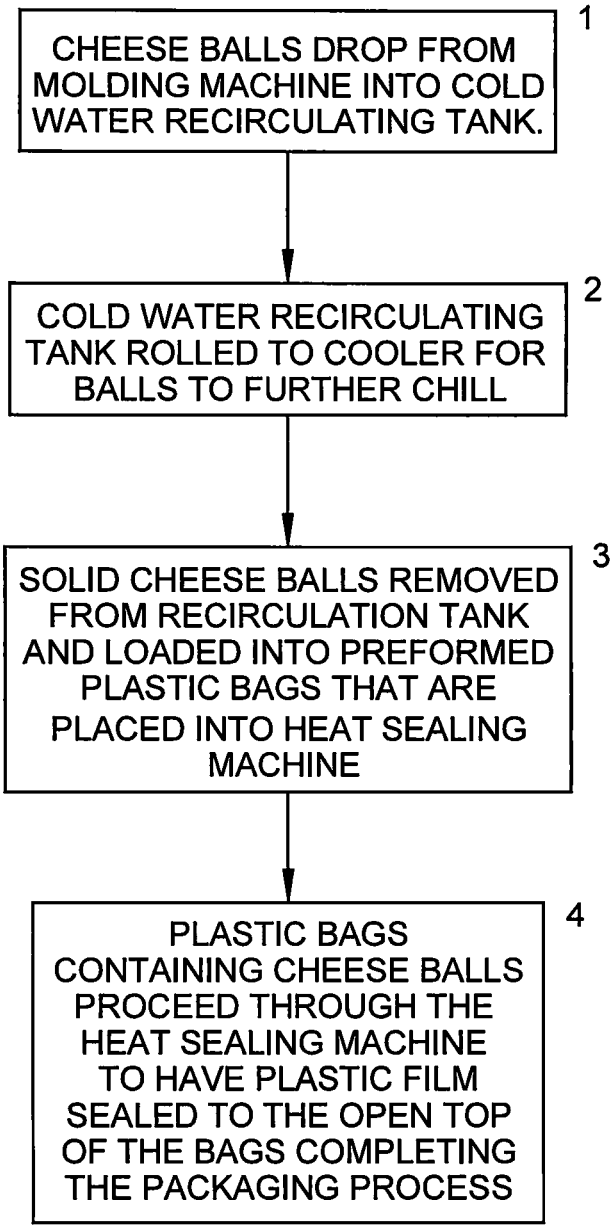
FIG. 1 (PRIOR ART)
FIG. 1 is a flowchart of the traditional steps for processing and packaging pasta filata type cheeses.
Figure 2:
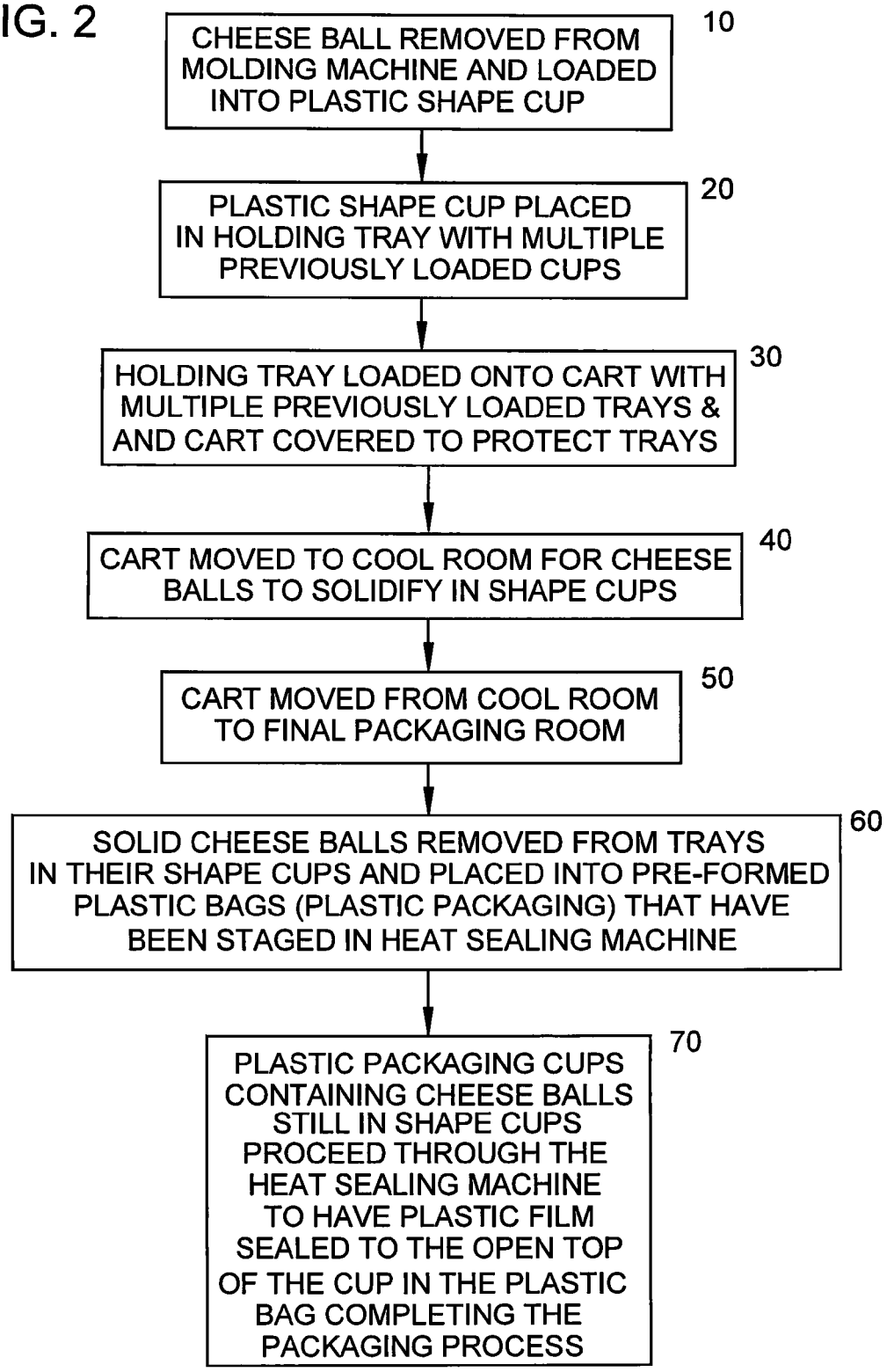
FIG. 2 is a flowchart of the novel steps for processing and packaging pasta filata type cheeses according to the invention.

FIG. 2 is a flowchart of the novel steps 10-70 for processing and packaging pasta filata type cheeses according to the invention.

Figure 3:
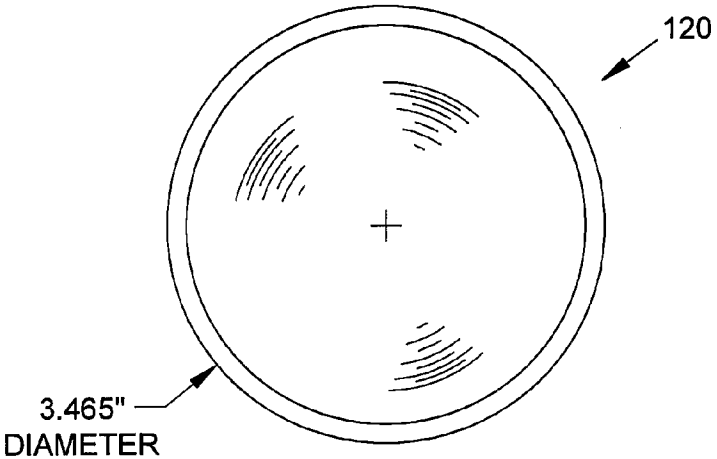
FIG. 3 is a top view of the novel dome container used in the subject invention.
Figure 4:
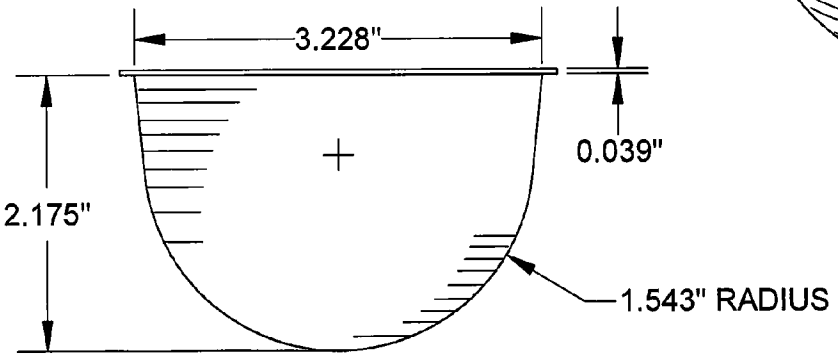
FIG. 4 is a side view of the dome container of FIG. 3.
Figure 5:
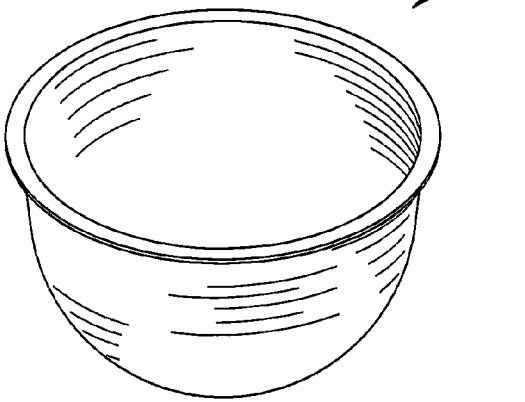
FIG. 5 is a perspective view of the dome container of FIGS. 3-5.
Figure 6:
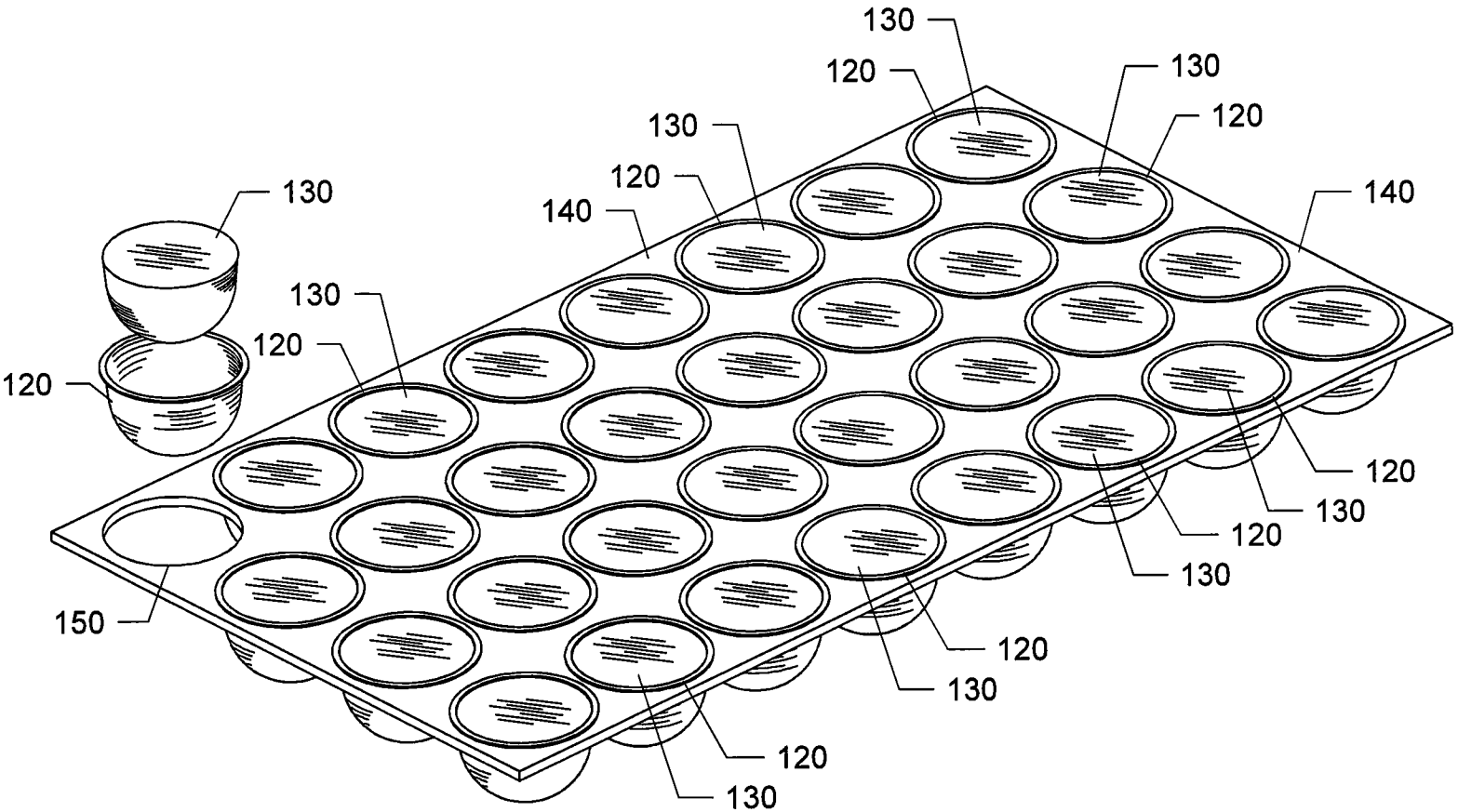
FIG. 6 shows the cheese balls being placed in the dome covers and into compartments of a tray according to the invention.
Figure 7:
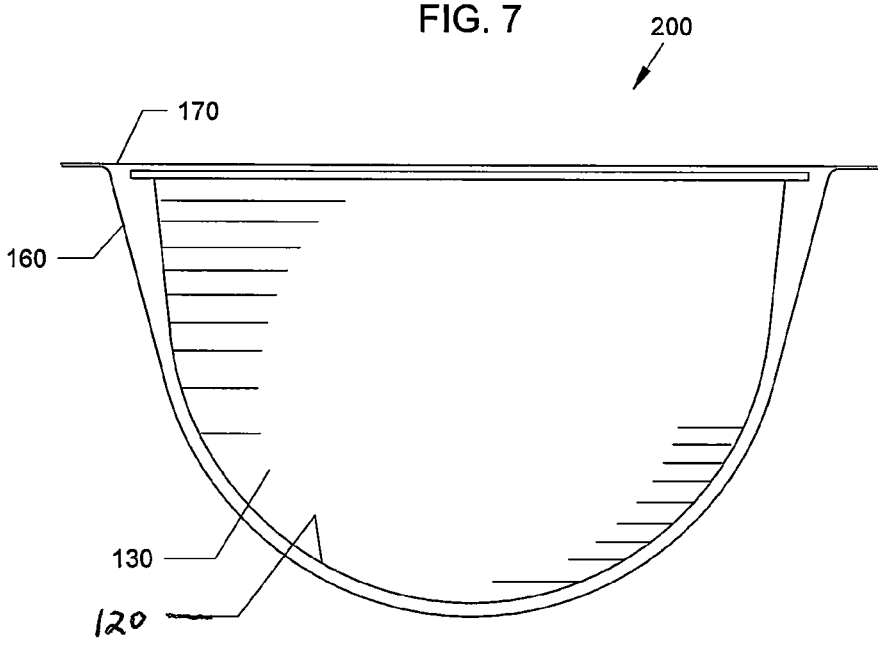
FIG. 7 is a side view of the plastic dome container with cheese inside packaged in a bag with heat seal attached top film.

FIG. 3 is a top view of the novel dome container 120 used in the subject invention. FIG. 4 is a side view of the dome container 120 of FIG. 3. FIG. 5 is a perspective view of the dome container 120 of FIGS. 3-5. FIG. 6 shows the cheese balls 130 being placed in the dome containers 120 and into compartments of a tray 150 according to the invention. FIG. 7 is a side view of the plastic dome container 120 with cheese 130 inside packaged in a bag 160 with heat seal attached top film 170.

Referring to FIGS. 2-7, the first step 10 has the cheese ball being removed from a molding machine (as described in the background section). With the novel invention, the cheese ball 130, can be anyone of the pasta filata cheeses that include stretched-curd, pulled-curd, and plastic-curd cheeses. The cheeses can be selected from any one of Mozzarella, Provolone, Caciocavallo Silano, Pallone di Gravina and Scamorza, formed from cow milk, buffalo milk, goat milk, and the like.

In the first step 10, the molded cheese ball 130 can be loaded into a novel plastic shape cup (dome container) 120. The dome container 120 can be made from a thermoforming plastic with UV (ultra violet) and Oxygen barrier, and be a clear see-through plastic.

An embodiment of the dome container 120 can have a flat top with rim having a diameter of approximately 3.465", and inner diameter across the top of approximately 3.228", with the rim having a thickness of approximately 0.039". The height of the dome container 120 can be approximately 2.175" with a dome shape (rounded bottom having a radius of approximately 1.543". The walls of the dome container 120 can be approximately 25 mills to approximately 30 mills thick so that the dome container has generally rigid side walls which do not easily deform.

In the second step, 20, the plastic shape cup (dome container) 120 with cheese 130 is placed into separate compartments 150 of a holding tray 140.

After all tray compartments 150 are all filled, it is then placed into a box container in a cart having sides, with an open top, as shown in the third step 30. When the box in the cart is filled up with trays 140 all filled with cheese 130 inside plastic shape cup(s) 120, the upper open top of the cart is then covered by a protective cover, such as but not limited to a plastic sheet, nylon sheet, cotton sheet, and the like.

In the fourth step 40, the filled cart is moved to a cool room (chilled room) having a temperature of approximately 32 F to approximately 40 F to allow for the cheese balls 130 to solidify in the shape cups 120. The cart can stay in the cool room up to several hours to solidify but not freeze the cheese so that the cheese remains soft but with a non liquid consistency In the fifth step, 50 the cart is moved from the cool room to a final packaging room. In the sixth step 60, the solid cheese balls 130 with their dome containers 120 are removed from the trays 140, and then placed into pre-formed plastic bags (such as those described in the background section which can have thicknesses of approximately 7 mills to approximately 8 mills) that have been staged in a heat sealing machine. The plastic bag can be formed from a thermoforming plastic with UV and Oxygen barrier.

In the final step, the cheese 130 in their dome containers 120 which are inside the clear see-through plastic bags proceed through the heat sealing machine to have a top plastic film (also approximately 7 mills to approximately 8 mills thick) sealed to the rim about the open top of the cup (dome container) 120, which completes the packaging process for one of the cheese balls 130.

The final packaging process continues for heat sealing of the top plastic film to rims of a dome shape container 120 with cheese 130 inside another plastic bag, for each additional cheese 130. FIG. 7 is a side view of the plastic dome container 120 with cheese 130 inside packaged in a bag 160 with heat seal attached top film 170.

The novel invention process steps described in FIG. 2 eliminates the water tank which eliminates the chances of forming at least one type of contamination. Bacteria is easier to reproduce in wet and moist environments which occurs in the prior art techniques. Eliminating the water tank reduces contamination of all the cheese balls in the tank from being cross-contaminated by one cheese ball being handled by unprotected hands of a handler.

The covered cart described in the novel steps of FIG. 2 further eliminates airborne contamination which occurs in the uncovered water tank described in the prior art referenced in the background section.

The rigid walls of the dome container 120 allow for maintaining the still pliable cheese in a hemi-spherical ball shape, unlike the prior art technique which does not protect against deformations, dents and unsightly marks being formed in the cheese by the very pliable plastic bag.

Although the embodiment describes a bag and film cover, the invention can be used with only a film cover 170 sealing the upper open end of the dome container 120 without the bag, by sealing the film cover onto the dome rim.

The term "approximately" can be +/−10% of the amount referenced. Additionally, preferred amounts and ranges can include the amounts and ranges referenced without the prefix of being approximately.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A process for packaging cheese comprising the steps of:
- providing a plastic dome having an upper open end and a lower rounded closed end, and a rim having a uniform diameter extending outwardly from the upper open end of the plastic dome;
- providing a plastic bag having an open end and a closed bottom end;
- providing a single plastic planar film;
- inserting cheese into the upper open end of the plastic dome;
- placing the lower rounded closed end of the dome with the cheese into the open end of the plastic bag; and
- sealing the single plastic planar film to close off the open end of the bag holding the dome and the cheese, and sealing the single plastic planar film to the rim about the open end of the plastic dome.

2. The process of claim 1, further comprising the step of:
- providing a pasta filata cheese as the cheese.

3. The process of claim 1, wherein the plastic dome includes walls having a thickness of approximately 25 mils to approximately 30 mils.

4. The process of claim 1, wherein the plastic bag and the single plastic planar film each have a thickness of approximately 7 mils to approximately 8 mils.

5. The process of claim 1, further comprising the step of:
- forming the plastic dome from a UV (ultra violet) and Oxygen barrier, as a clear see-through plastic.

6. The process of claim 1, wherein the sealing step includes the step of:
- heat sealing the plastic film to both the rim on the upper open end of the dome and the open end of the bag.

7. The process of claim 1, wherein the plastic dome and the rim consists of a single unitary and monolithic plastic dome with the rim.

8. A process for packaging cheese comprising the steps of:
- providing a plastic dome having an upper open end and a lower rounded closed end, and a rim on the upper open end of the plastic dome;
- providing a plastic bag having an open end and a closed bottom end;
- providing a single plastic planar film;
- inserting cheese into the upper open end of the plastic dome;
- placing the lower rounded closed end of the dome with the cheese into the open end of the plastic bag; and
- sealing the single plastic planar film to close off the open end of the bag holding the dome and the cheese, and sealing the single plastic planar film to the rim of the plastic dome.

9. The process of claim 8, wherein the plastic dome and the rim consists of a single unitary and monolithic plastic dome with the rim.

10. A see-through container for cheese, comprising:
- a plastic dome having an open upper end, and sidewalls which run down to a closed rounded bottom end, and a rim about the open upper end of the plastic dome;
- cheese stored inside of the dome;
- a plastic bag having an open end and a closed bottom end, with the plastic dome and the cheese stored inside the dome positioned inside the open end of the plastic bag; and
- a single planar plastic film sealed to close off the open end of the bag and sealed to the rim about the open upper end of the plastic dome.

11. The cheese container of claim 10, wherein the sidewalls and closed bottom end of the dome have a wall thickness of approximately 25 mils to approximately 30 mils.

12. The cheese container of claim 10, wherein the plastic dome and the rim consists of a single unitary and monolithic plastic dome with the rim.

* * * * *